US007111532B2

(12) United States Patent
Wu

(10) Patent No.: US 7,111,532 B2
(45) Date of Patent: Sep. 26, 2006

(54) TORQUE WRENCH

(76) Inventor: Izu Min Wu, P.O. Box 63-298, Taichung 40699 (TW)

( * ) Notice: Subject to any disclaimer, the term of this patent is extended or adjusted under 35 U.S.C. 154(b) by 49 days.

(21) Appl. No.: 10/990,812

(22) Filed: Nov. 18, 2004

(65) Prior Publication Data

US 2006/0101954 A1 May 18, 2006

(51) Int. Cl.
*B25B 23/159* (2006.01)

(52) U.S. Cl. ..... 81/478; 81/483

(58) Field of Classification Search ..... 81/467, 81/473–476, 478, 480, 481, 483
See application file for complete search history.

(56) References Cited

U.S. PATENT DOCUMENTS

| | | | | |
|---|---|---|---|---|
| 2,732,747 | A * | 1/1956 | Livermont | 81/483 |
| 2,996,940 | A * | 8/1961 | Hoose | 81/481 |
| 4,467,678 | A | 8/1984 | Lindholm | 81/483 |
| 4,732,062 | A * | 3/1988 | Grabovac et al. | 81/483 |
| 4,870,879 | A | 10/1989 | Shieh | 81/483 |
| 5,152,200 | A * | 10/1992 | Kaplan | 81/478 |
| 5,497,682 | A | 3/1996 | Hsu | 81/483 |
| 6,334,377 | B1 * | 1/2002 | Wu | 81/478 |
| 6,722,235 | B1 * | 4/2004 | Hsieh | 81/478 |
| 6,742,418 | B1 * | 6/2004 | Amami | 81/478 |

* cited by examiner

*Primary Examiner*—Debra S Meislin
(74) *Attorney, Agent, or Firm*—Charles E. Baxley

(57) ABSTRACT

A torque wrench includes a driving shank received in a handle and having an intermediate portion pivotally attached to the handle with a pivot axle, and having two projections, a follower is slidably received in the handle and biased to engage with the driving shank by a spring biasing member, and two guiding members are fitted and retained between the driving shank and the handle and each includes a groove for slidably receiving the projections of the driving shank, and thus to stably guide the inner end of the driving shank to rotate and to move within the handle and to prevent the driving shank from being tilted or swung or vibrated relative to the handle. The grooves of the guiding members include a center of curvature located at the pivot axle of the driving shank and the handle.

8 Claims, 3 Drawing Sheets

TORQUE WRENCH

BACKGROUND OF THE INVENTION

1. Field of the Invention

The present invention relates to a torque wrench, and more particularly to a torque wrench having a stably guiding member provided for stably guiding an elongated driving shank to rotate or to move within a tubular handle, and for preventing the elongated driving shank from being tilted or swung or vibrated relative to the tubular handle.

2. Description of the Prior Art

Various kinds of typical torque wrenches have been developed and comprise an elongated shank rotatably or pivotally engaged in a tubular handle, and a predetermined or selectively variable torque applied onto the shank by a spring biasing member and/or a spherical coupling member, to effect pivotal movement of the handle and to create an audible indication to the operator when the predetermined or selectively variable torque is applied onto a torque transfer axis of the shank and the handle.

For example, U.S. Pat. No. 4,467,678 to Lindholm discloses one of the typical torque wrenches comprising a spherical coupling member attached to a free end of an elongated shank and engageable into a recess of a spring biased follower which is urged against the spherical coupling member so as to maintain the spherical coupling member within the recess of the spring biased follower by a coil compression spring.

However, the free end of the elongated shank is not limited to rotate or to move relative to the handle and may thus move toward various directions, and may thus be tilted or swung or vibrated relative to the tubular handle.

U.S. Pat. No. 4,870,879 to Shieh discloses another typical torque wrench comprising a shank pin attached to a free end of a ratchet arm and engageable with a rotatable roller that is attached to a spring biased sleeve which will urge the roller against the shank pin so as to create an audible indication to the operator when the predetermined or selectively variable torque is applied onto a torque transfer axis of the ratchet arm and an outer housing.

A screw is threaded to the ratchet arm, to adjust the moving range of the free end of the ratchet arm relative to the outer housing. However, similarly, the free end of the elongated ratchet arm is not limited to rotate or to move relative to the outer housing and may thus also move toward various directions, and may thus be tilted or swung or vibrated relative to the outer housing.

U.S. Pat. No. 5,497,682 to Hsu discloses a further typical torque wrench comprising a parallelepiped connector engaged into a recess of a knocker and engageable into another recess of a shank. However, the recesses of the knocker and the shank are also parallelepiped or include a non-circular cross section, such that the connector may not be easily disengaged from the knocker or the shank.

Similarly, the knocker is also not limited to rotate or to move relative to an outer casing and may thus also move toward various directions, and may thus be tilted or swung or vibrated relative to the outer casing.

The present invention has arisen to mitigate and/or obviate the afore-described disadvantages of the conventional torque wrenches.

SUMMARY OF THE INVENTION

The primary objective of the present invention is to provide a torque wrench including a stably guiding member provided for stably guiding an elongated shank to rotate or to move within a tubular handle, and for preventing the elongated shank from being tilted or swung or vibrated relative to the tubular handle.

The other objective of the present invention is to provide a torque wrench including a guiding member stably and easily and readily disposed or engaged and secured between the elongated shank and the tubular handle without additional fasteners, latches or the like.

The further objective of the present invention is to provide a torque wrench including a guiding member having a curved groove formed therein to slidably receive corresponding projections from the shank, and to guide the shank to smoothly slide or move relative to the handle.

In accordance with one aspect of the invention, there is provided a torque wrench comprising a handle including a bore formed therein and defined by an inner peripheral surface, and including a first end and a second end, a driving shank received in the bore of the handle and including an intermediate portion pivotally attached to the first end of the handle with a pivot axle, to allow the driving shank to be pivoted relative to the handle, the driving shank including a driving head provided on an outer end thereof and including an inner end received in the bore of the handle, a follower slidably received in the bore of the handle, a spring biasing member engaged with the follower and biasing and forcing the follower to engage with the driving shank and thus to applying a torque against the driving shank, and two guiding members fitted and retained between the driving shank and the handle, and each including a groove formed therein. The driving shank includes two projections attached to the inner end thereof, and extended out of the driving shank respectively, and slidably received in the grooves of the guiding members respectively, to stably guide the inner end of the driving shank to rotate and to move within the handle and to prevent the driving shank from being tilted or swung or vibrated relative to the handle.

The grooves of the guiding members include a center of curvature located at the pivot axle of the driving shank and the handle, to allow the projections of the driving shank to be smoothly and slidably received within the grooves of the guiding members respectively.

The driving shank includes two flat surfaces oppositely formed thereon, the guiding members each includes a flat inner surface formed therein for engaging with the flat surfaces of the driving shank respectively, and each includes a curved outer surface for engaging with the inner peripheral surface of the handle, to allow the guiding members to be snugly fitted and retained between the driving shank and the handle.

The handle includes an inner peripheral shoulder formed therein, for engaging with the guiding members and for anchoring the guiding members to the handle. The driving shank includes a coupling member attached to the inner end thereof, the follower includes a roller attached to top thereof, for engaging with the coupling member of the driving shank.

The driving shank includes a protrusion extended form the inner end thereof, for engaging with the handle, and for limiting a rotational movement of the driving shank relative to the handle. The driving shank includes an inclined surface formed in bottom of the inner end thereof, and having the protrusion attached to the inclined surface thereof.

The handle includes a hand grip rotatably attached to a lower portion thereof, for engaging with the spring biasing member, and for adjusting the spring biasing member to apply selective or different spring biasing force against the driving shank.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
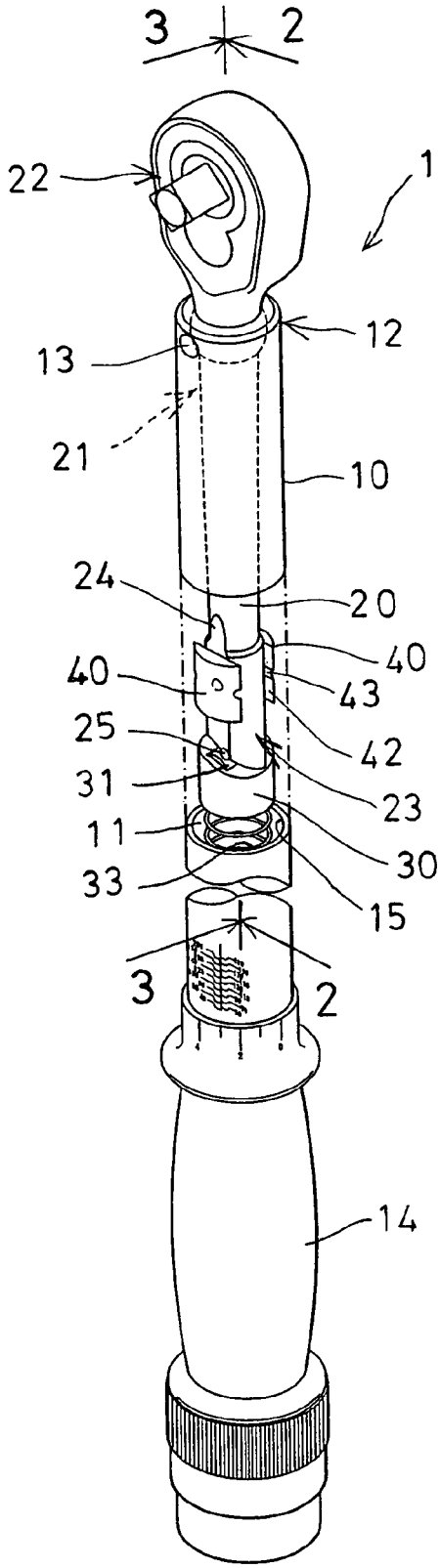
FIG. 1 is a perspective view of a torque wrench in accordance with the present invention, in which a portion of an outer handle has been cut off for showing an inner structure of the torque wrench.
Figure 2:
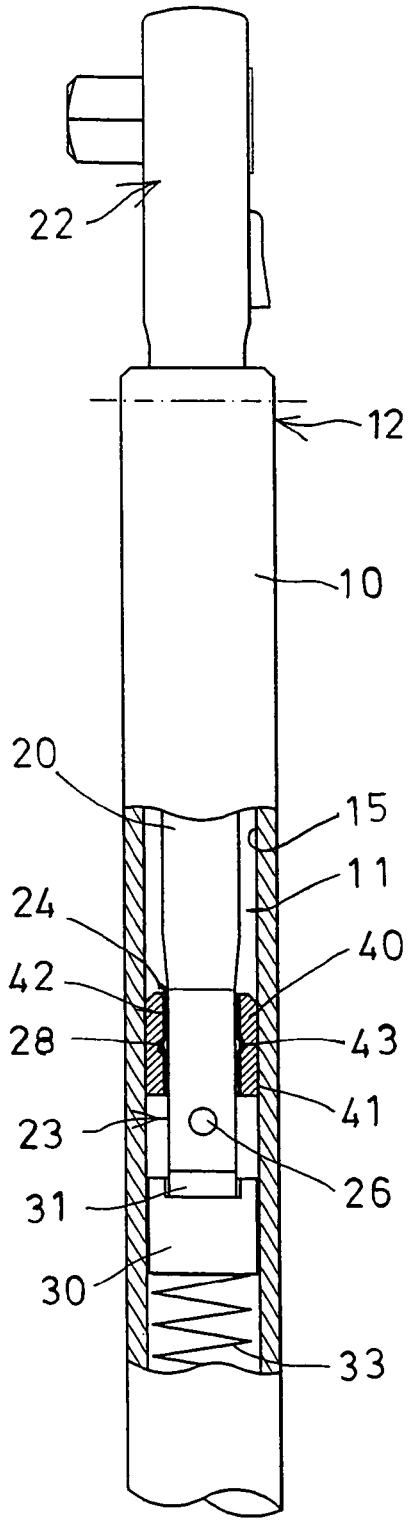
FIG. 2 is a partial cross sectional view of the torque wrench, taken along lines 2—2 of FIG. 1.
Figure 3:
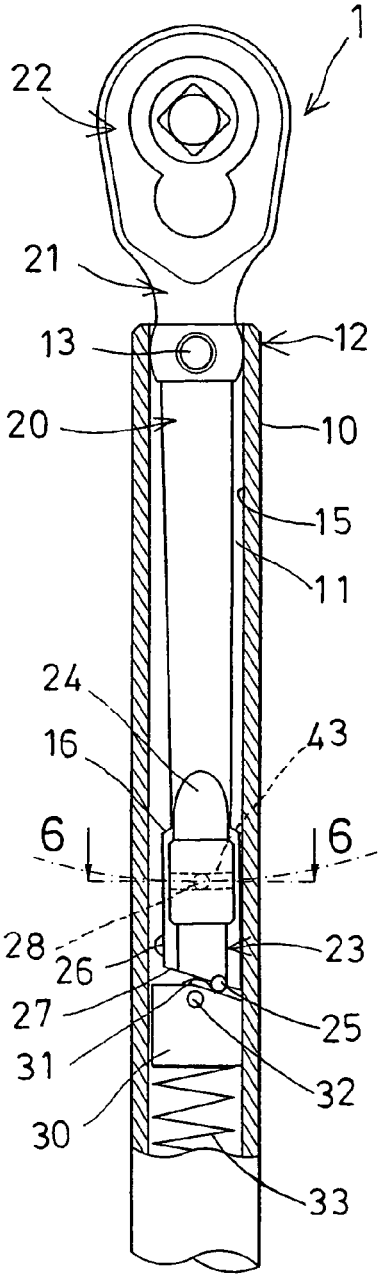
FIG. 3 is a partial cross sectional view of the torque wrench, taken along lines 3—3 of FIG. 1.

Referring to the drawings, and initially to FIGS. 1–3, a torque wrench 1 in accordance with the present invention comprises an elongated or tubular handle 10 including a bore 11 formed therein, and a driving shank 20 partially received in the bore 11 of the handle 10 and including an intermediate portion 21 rotatably or pivotally attached to one end 12 of the handle 10 with a pivot axle 13, to allow the driving shank 20 to be rotated or pivoted relative to the handle 10.

The driving shank 20 includes a driving head 22, such as a ratchet driving head 22 provided on one end or outer end thereof, and extended out of the handle 10, for engaging with and for driving fasteners, tool members, or the like, and includes another end or inner end 23 having one or more, such as two flat surfaces 24 oppositely formed thereon. A spherical or roller-shaped or pin-shaped coupling member 25 is attached to the inner end 23 of the driving shank 20.

A protrusion 26 is extended laterally out from the inner end 23 of the driving shank 20 (FIGS. 3, 4) for engaging with or for impacting onto the handle 10 (FIG. 4), and for limiting a rotational movement of the driving shank 20 relative to the handle 10. It is preferable that the driving shank 20 includes a tilted or inclined surface 27 formed in bottom of the inner end 23 thereof, and thus having the coupling member 25 attached to the inclined surface 27 thereof.

A follower 30 is slidably received in the bore 11 of the handle 10 and includes a roller 31 rotatably or pivotally attached to top thereof with a pivot shaft 32, for engaging with the spherical or roller-shaped or pin-shaped coupling member 25 and/or the driving shank 20, and a spring biasing member 33 is engaged with the follower 30, for biasing or forcing the follower 30 and/or the roller 31 to engage with the driving shank 20, and thus for applying a predetermined or selectively variable torque against the driving shank 20.

For example, the handle 10 may include a hand grip 14 rotatably or pivotally or threadedly attached to a lower portion thereof, for engaging with the spring biasing member 33, and for adjusting the spring biasing member 33 to apply selective or different spring biasing force or torque against the driving shank 20, and thus to effect pivotal movement of the handle 10 and thus to create an audible indication to the operator when the predetermined or selectively variable torque is applied onto the driving shank 20. The above-identified structure is typical and thus will not be described in further details.

Figure 6:
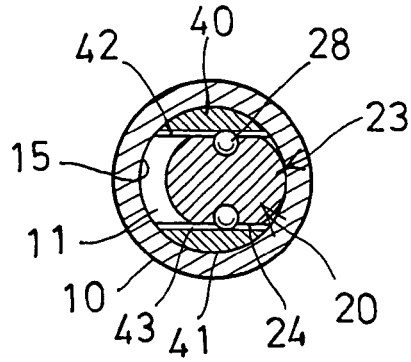
FIGS. 6, 7 are cross sectional views of the torque wrench, taken along lines 6—6, and 7—7 of FIGS. 3 and 4 respectively, illustrating the operation of the torque wrench.
Figure 7:
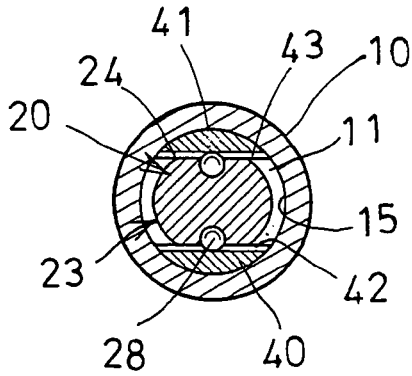

The driving shank 20 includes one or more, such as two spherical projections 28 attached to the inner end 23 thereof, such as attached to or engaged in the two opposite flat surfaces 24 of the driving shank 20 respectively, best shown in FIGS. 6, 7, and slightly extended out of the two opposite flat surfaces 24 of the driving shank 20 respectively.

Two guiding members 40 are attached onto the inner end 23 of the driving shank 20, and each includes a curved outer surface 41 for engaging with an inner peripheral surface 15 of the handle 10, and each includes a flat inner surface 42 for engaging with the flat surfaces 24 of the driving shank 20 respectively, and thus for allowing the guiding members 40 to be snugly fitted and retained between the driving shank 20 and the handle 10.

Each of the guiding members 40 further includes a groove 43 laterally formed therein, such as formed in the flat inner surface 42 thereof (FIGS. 3–7), for slidably receiving the projections 28 of the driving shank 20 respectively, and thus for stably guiding the inner end 23 of the driving shank 20 to rotate or to slide or to move within the handle 10, and for preventing the driving shank 20 from being tilted or swung or vibrated relative to the handle 10.

Figure 4:
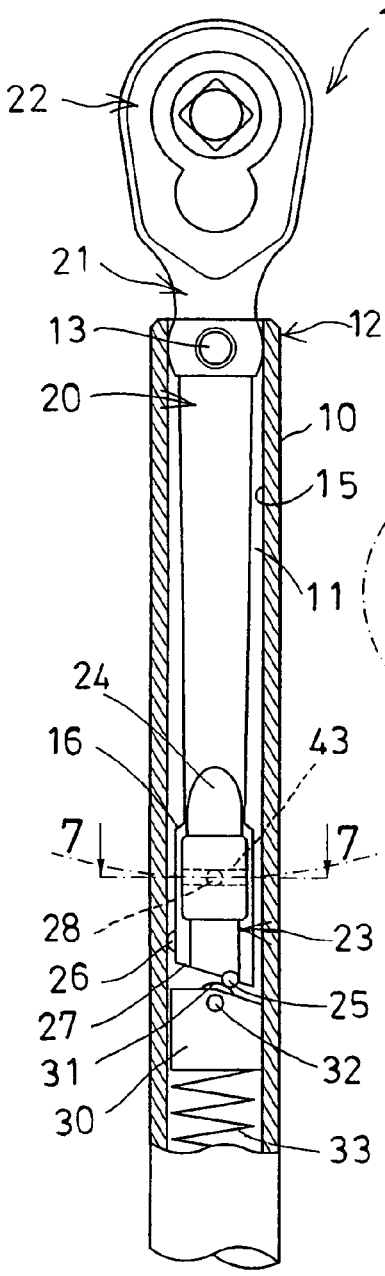
FIG. 4 is a partial cross sectional view similar to FIG. 3, illustrating the operation of the torque wrench.
Figure 5:
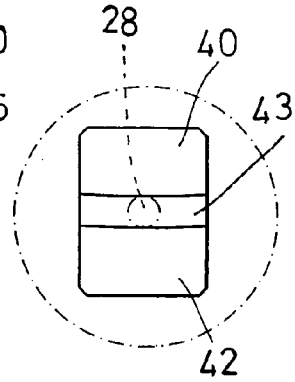
FIG. 5 is an enlarged plan view of a guiding member for the torque wrench.

As best shown in FIGS. 3 and 4, the grooves 43 of the guiding members 40 each preferably includes a curvature center or a center of rotation or center of curvature located at the pivot axle 13 of the driving shank 20 and the handle 10, to allow the projections 28 of the driving shank 20 to be smoothly and slidably received within the grooves 43 of the guiding members 40 respectively.

As best shown in FIGS. 6 and 7, the guiding members 40 may be snugly fitted and retained between the driving shank 20 and the handle 10 and may be retained in place by the engagement of the projections 28 of the driving shank 20 in the grooves 43 of the guiding members 40, such that the guiding members 40 are not required to be secured to the driving shank 20 and the handle 10 with additional fasteners or latches or the like.

It is preferable that the handle 10 further includes an inner peripheral shoulder 16 formed therein (FIGS. 3, 4), for such as engaging with the guiding members 40, and for anchoring the guiding members 40 to the handle 10, and/or for preventing the guiding members 40 from being moved relative to the handle 10.

Accordingly, the torque wrench in accordance with the present invention includes a stably guiding member provided for stably guiding an elongated shank to rotate or to move within a tubular handle, and for preventing the elongated shank from being tilted or swung or vibrated relative to the tubular handle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A torque wrench comprising:

a handle including a bore formed therein and defined by an inner peripheral surface, and including a first end and a second end, a driving shank received in said bore of said handle and including an intermediate portion pivotally attached to said first end of said handle with a pivot axle, to allow said driving shank to be pivoted relative to said handle, said driving shank including a driving head provided on an outer end thereof and including an inner end received in said bore of said handle, a follower slidably received in said bore of said handle, a spring biasing member engaged with said follower and biasing and forcing said follower to engage with said driving shank and thus to applying a torque against said driving shank, two guiding members fitted and retained between said driving shank and said handle, and each including a groove formed therein, and said driving shank including two projections attached to said inner end thereof, and extended out of said driving shank respectively, and slidably received in said grooves of said guiding members respectively, to stably guide said inner end of said driving shank to rotate and to move within said handle and to prevent said driving shank from being tilted or swung or vibrated relative to said handle.

2. The torque wrench as claimed in claim 1, wherein said grooves of said guiding members include a center of curvature located at said pivot axle of said driving shank and said handle, to allow said projections of said driving shank to be smoothly and slidably received within said grooves of said guiding members respectively.

3. The torque wrench as claimed in claim 1, wherein said driving shank includes two flat surfaces oppositely formed thereon, said guiding members each includes a flat inner surface formed therein for engaging with said flat surfaces of said driving shank respectively, and each includes a curved outer surface for engaging with said inner peripheral surface of said handle, to allow said guiding members to be snugly fitted and retained between said driving shank and said handle.

4. The torque wrench as claimed in claim 1, wherein said handle includes an inner peripheral shoulder formed therein, for engaging with said guiding members and for anchoring said guiding members to said handle.

5. The torque wrench as claimed in claim 1, wherein said driving shank includes a coupling member attached to said inner end thereof, said follower includes a roller attached to top thereof, for engaging with said coupling member of said driving shank.

6. The torque wrench as claimed in claim 1, wherein said driving shank includes a protrusion extended form said inner end thereof, for engaging with said handle, and for limiting a rotational movement of said driving shank relative to said handle.

7. The torque wrench as claimed in claim 5, wherein said driving shank includes an inclined surface formed in bottom of said inner end thereof, and having said coupling member attached to said inclined surface thereof.

8. The torque wrench as claimed in claim 1, wherein said handle includes a hand grip rotatably attached to a lower portion thereof, for engaging with said spring biasing member, and for adjusting said spring biasing member to apply selective spring biasing force against said driving shank.

* * * * *